US005616172A

United States Patent [19]

Tuckerman et al.

[11] Patent Number: 5,616,172

[45] Date of Patent: Apr. 1, 1997

[54] AIR TREATMENT SYSTEM

[75] Inventors: Mark A. Tuckerman, Haddam; Russell P. Knuth, Killingworth; William F. Carey, West Hartford, all of Conn.

[73] Assignee: Nature's Quarters, Inc.

[21] Appl. No.: 607,725

[22] Filed: Feb. 27, 1996

[51] Int. Cl.[6] ..... B03C 3/016

[52] U.S. Cl. ..... 96/16; 55/279; 55/356; 96/26; 96/55; 96/57; 96/63; 422/24

[58] Field of Search ..... 96/16, 62, 97, 96/55, 63, 26, 18, 57–59; 55/279, 356; 422/24, 121

[56] References Cited

U.S. PATENT DOCUMENTS

| | | | |
|---|---|---|---|
| 2,478,393 | 8/1949 | Haarman | 34/80 |
| 2,709,954 | 6/1955 | Baker | 96/16 |
| 3,299,620 | 1/1967 | Hollingworth | 96/53 |
| 3,518,046 | 6/1970 | Cicirello | 55/279 X |
| 3,576,593 | 4/1971 | Cicirello | 55/279 X |
| 3,683,638 | 8/1972 | Devon | 55/279 X |
| 3,812,370 | 5/1974 | LaViolette | 55/279 X |
| 4,210,429 | 7/1980 | Golstein | 55/279 |
| 4,531,956 | 7/1985 | Howorth | 55/279 |
| 4,737,173 | 4/1988 | Kudirka et al. | 55/276 |
| 4,749,385 | 6/1988 | Brunner et al. | 95/273 |
| 4,787,922 | 11/1988 | Kulitz | 55/274 |
| 4,900,344 | 2/1990 | Lansing | 55/322 |
| 4,909,815 | 3/1990 | Meyer | 55/356 X |
| 4,959,010 | 9/1990 | Burtscher et al. | 96/16 X |
| 5,069,691 | 12/1991 | Travis et al. | 55/356 X |
| 5,225,167 | 7/1993 | Wetzel | 422/121 |
| 5,240,478 | 8/1993 | Messina | 55/356 X |

*Primary Examiner*—Richard L. Chiesa
*Attorney, Agent, or Firm*—Albert W. Hilburger

[57] ABSTRACT

A self contained air movement system for air purification and infection control includes an elongated upright enclosed housing including a base module, sidewalls, and an upper module. A fan intermediate the base module and the upper module draws unclean air from a room containing the system through the base module, then discharges a purified air stream from the upper module. The base module includes a downward facing air intake opening spaced from the floor. A pair of pre-filters are disposed on the base module in stacked relationship for trapping relatively large particulate matter from the entering air stream. The upper module includes a discharge grille opening to the environment with angled louvers for guiding and re-directing the purified air stream from a downstream HEPA-type filter into an inclined stream, flowing proximate to and along the ceiling of the room in which the system is located. A germicidal chamber intermediate the pre-filters and the fan contains a plurality of elongated and longitudinally extending ultraviolet germicidal irradiation lamps. Because of the remoteness of the upper module from the base module, undesirable mixing of unclean and purified air is minimized. In another embodiment, the discharge grille has a first opening with angled louvers as in the first embodiment and a second opening to which an attached conduit leads to an exterior region outside of the room to thereby create a negative pressure in the room in relation to the exterior region.

14 Claims, 3 Drawing Sheets

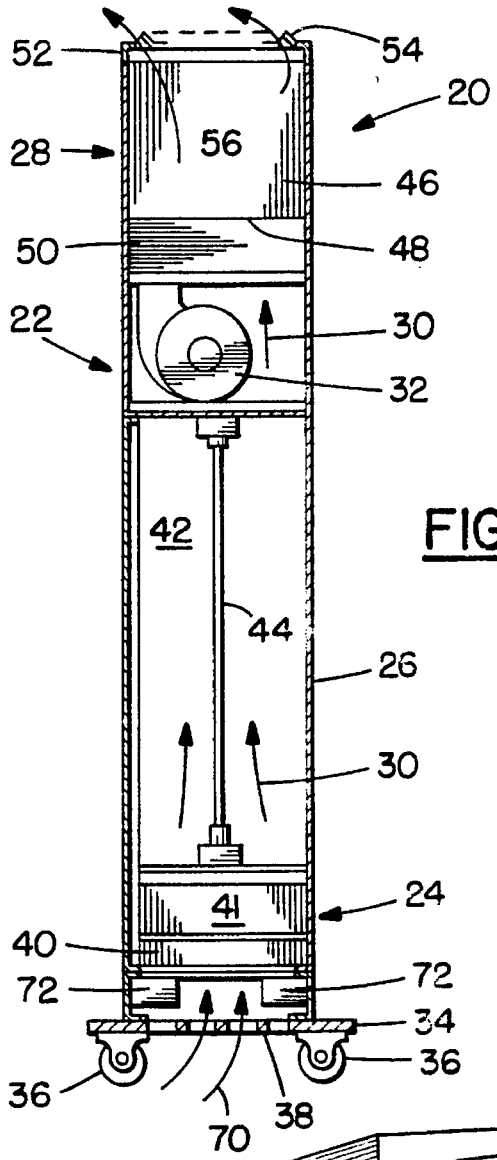
FIG. 3.
FIG. 4.
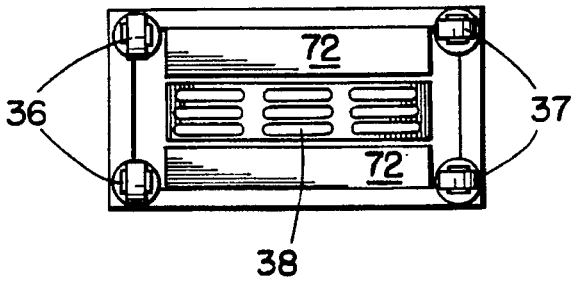
FIG. 6.
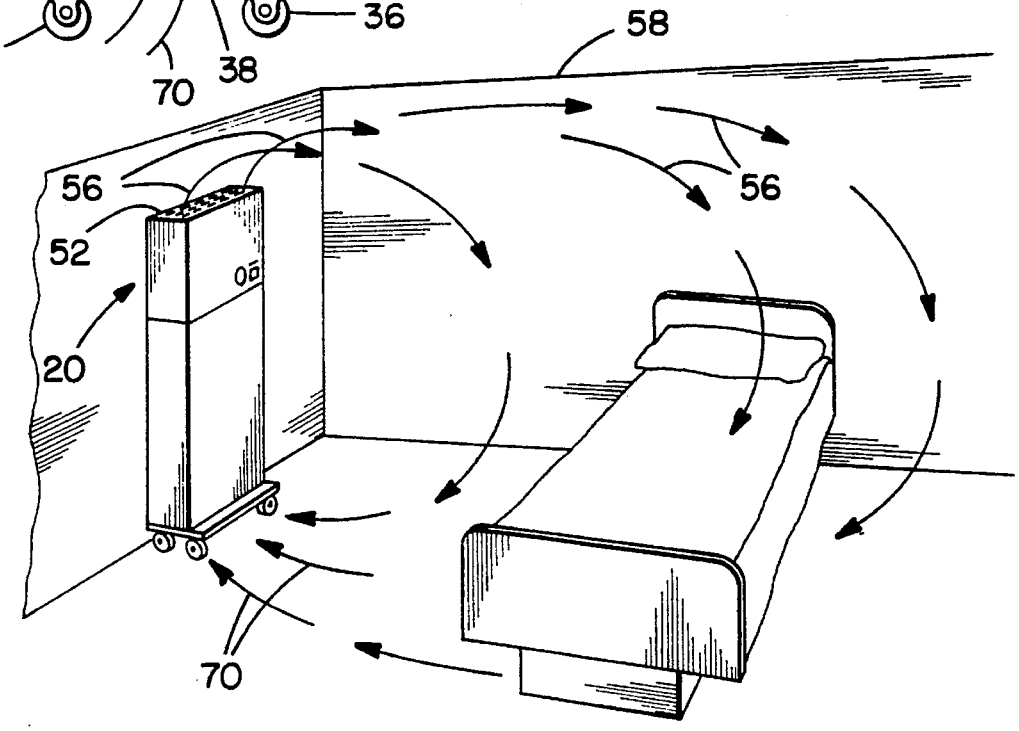

AIR TREATMENT SYSTEM

BACKGROUND OF THE INVENTION

1. Field of the Invention

This invention relates generally to a self-contained portable air movement and purification system, and more particularly, to such a system which is capable of removing particulate and bacterial contaminants and generally purifying air to hospital standards.

2. Discussion of the Prior Art

A wide variety of air filter systems are presently available for use. These systems typically include a fan arrangement for circulating air, and a filter stage or perhaps several filter stages disposed in the air path so as to filter or otherwise purify air flowing therethrough. The air filters differ widely in their volume capacity, their efficiency of filtration, and their ease of portability.

Several different types of filtering stages are available for use in present day air filter systems. The air filter stage may have, for example, an electrostatic precipitator type of element which charges dust or other airborne contaminants and attracts the airborne contaminants to an electrically charged grid. In general, electrostatic air filter stages are expensive to fabricate and install, and they often require relatively costly maintenance. In addition, there is a substantial electrical power requirement over and above that needed for maintaining an air flow through the filter stage.

As another general type of air filtering, one or more layers of porous media alone are disposed in an air flow path for "mechanically" filtering or trapping airborne particles contained in the air flow. In general, if a greater efficiency of filtering is desired, additional stages or filtering layers are added. This, however, multiplies the cost of the initial filtering stage and frequently results in a significant pressure drop across the filter, thus requiring a higher fan capacity with greater electrical consumption for maintaining a desired air flow.

Users of air filter systems are frequently concerned about the amount of air treated by a filter stage in a given time period, for example, requiring several changes of air volume in a room, for each hour of operation of the air filter system. This concept of room air filtering is frequently expressed as a number of "room air changes" per hour. For purposes of comparison, building codes frequently require that public restaurants and similar public buildings have at least one or two air changes per hour, meaning that a volume of air equal to that required to fill a room is completely removed and replaced by fresh air at least once or twice each hour that the room is open to the public. The present invention is particularly concerned with providing an air filter system capable of filtering the air in an entire room on the order of several times per hour.

In a practical air filter system, much more is needed than simply providing sufficient fan capacity to "turn over" the air filling a room at the desired rate. For example, the efficiency of the filter media, over its life span must be considered. As air is caused to flow through a porous filter media, airborne particles and the like are trapped in the filter media, thus reducing its porosity and increasing the resistance of the air flow through the filter stage.

Other types of air filtering media may be provided which react with dissolved chemicals suspended in the air. Such filters frequently operate by adsorbing the chemical contaminants by collecting those contaminants in condensed form on the media surface. The adsorbed contaminants have the potential for changing the surface properties of the air filter media and in particular, have the potential of changing the resistance to air flow through the media. While an air filter stage could be "oversized" so as to provide a minimal acceptable air conductance at the end of its useful life, the cost of the air filter media in the stage rises significantly as does the size of that filter stage.

In addition, special considerations must be given to particular types of air filter media. For example, activated charcoal is a popular type of air filter media in use today and is frequently utilized as a bed of charcoal particles through which an air flow is conducted.

Presently, there exists a need for a high volume portable room air filter having at least a minimum filtering efficiency for types of contaminants frequently encountered in everyday situations. Of particular interest is the availability of an effective portable air filter system for use in rooms frequented by the public, in smoke-filled offices, and especially in sick rooms of patients suffering from asthma, tuberculosis or other respiratory diseases. However, in order to be practical in use, the air filter system should be sufficiently small in size and readily portable so that it can be moved from room to room and so that it can also be easily moved within a room without significantly altering its operation or adversely affecting the comfort of occupants of the room. Several arrangements of portable room air filters have been proposed, yet the need for further improvements still exists.

Pollens, lung damaging dust, smoke, bacteria, viruses and any one of a number of other irritants and micro-organisms are quite likely in the air that everyone breathes. These irritants are carried by the wind, on people's clothing, on the hair or feathers of a pet, or sprayed about by a sneeze or a cough. Contact with these irritants is almost inevitable. Also, for persons plagued by the miseries of emphysema, asthma, hay fever or other allergies, contact with irritants and micro-organisms means un-pleasant discomfort and usually sleepless nights. Although different types of air purifiers presently exist, they are not completely effective in removing these irritants and micro-organisms from the air. Further, existing air purifiers do not provide the combination of effective removal of these contaminants along with the provision of a germicidal chamber for killing bacteria and virus. Specific examples of the prior art relating to air movement and purification systems will now be considered. U.S. Pat. No. 5,069,691 to Travis et al. discloses a portable vacuum and air filtration unit for cleaning heating, ventilation, and air conditioning ductwork in residential and commercial buildings. Filtered air is exhausted into the room in which the unit is located.

U.S. Pat. Nos. 4,900,344 to Lansing, 4,787,922 to Kulitz, 4,737,173 to Kudirka et al. and 4,531,956 to Howorth all disclose portable filtration devices for workplaces and the like. Howorth is of particular interest in providing a sterile air zone for surgery and surgical instruments. However, in each instance the devices are relatively short of stature and do not adequately provide separation of the clean exhaust air from the soiled intake air.

U.S. Pat. No. 4,749,385 to Brunner et al. discloses apparatus for providing clean and heated air simultaneously to a workplace such as on a production line for the manufacture of cathode ray tubes. Airflow is directed through a HEPA filter and an infrared heater and onto a panel assembly for the cathode ray tube. Ambient air is drawn into the apparatus through an annular intake surrounding a circular exhaust.

U.S. Pat. No. 4,909,815 to Meyer discloses mobile air cleaning apparatus especially suited for use in an automotive vehicle repair and/or assembly plant. Filtered air is directed downwardly over the surface of the vehicle, then captured at a location beneath the vehicle for return and additional filtration.

U.S. Pat. No. 3,299,620 to Hollingworth discloses apparatus for the treatment and purification of air which utilizes a liquid spray for cleansing the air of particulate matter.

U.S. Pat. No. 4,210,429 to Golstein et al. discloses an air purifier which incorporates a number of features improved over the earlier mentioned references including its relative height and the use of germicidal lamps. Nonetheless, the present invention is deemed to incorporate significant, patentable improvements thereon which will be related below.

It was in light of the prior art as just described that the present invention was conceived and has now been reduced to practice.

SUMMARY OF THE INVENTION

The present invention is directed to a self contained air movement and purification system which is focused on infection control. The system of the invention comprises an elongated upright enclosed housing including a base module, sidewalls, and an upper module. A fan intermediate the base module and the upper module draws unclean air from a room containing the system through the base module, then discharges a purified air stream from the upper module. The base module includes a downward facing air intake opening spaced from the floor. A pair of pre-filters are disposed on the base module in stacked relationship for trapping relatively large particulate matter from the entering air stream. The upper module includes a discharge grille opening to the environment with angled louvers for guiding and re-directing the purified air stream from a HEPA-type filter into an inclined stream, flowing proximate to and along the ceiling of the room in which the system is located. A germicidal chamber intermediate the pre-filters and the fan contains a plurality of elongated and longitudinally extending ultraviolet germicidal irradiation lamps. Because of the remoteness of the upper module from the base module, undesirable mixing of unclean and purified air is minimized. In another embodiment, the discharge grille has a first opening with angled louvers as in the first embodiment and a second opening to which an attached conduit leads to an exterior region outside Of the room to thereby create a negative pressure in the room in relation to the exterior region.

As with any apparatus which must be engineered, there are design trade-offs which must be, and have been, considered. In regard to the present invention, there were four objectives deemed to be of primary importance for the air treatment system, specifically, infection control efficacy, safety, administrative control of the equipment, and the users' subjective requirements. These, in turn, translated into key factors of: (1) airflow, (2) noise, (3) filtration/germicidal action, and (4) safety features.

(1) The airflow needs to be maximized within the constraints of noise, germicidal action and safety. Because the general infection control mechanism is to dilute the contaminated air with clean, safe air (up to 100% dilution) the more air that can be processed, the faster and more complete the dilution will be.

(2) Noise is a large user constraint: the higher the noise level of the equipment, the more objectionable it is to the people using the device. Noise originates with both the motor and the airflow. The higher the airflow, the noisier the unit will be and the more resistance in the air flow, the noisier the motor will be. The type of motor and fan blade design also influence the noise of the unit.

(3) Germicidal action is also influenced by the airflow through the unit. The faster the transit time of the air through the unit, the less the cumulative dosage imparted by the ultraviolet lamps (UVGI UltraViolet Germicidal Irradiation), and the less effective the UVGI is in killing the microbes. The use of a HEPA (High Efficiency Particulate Air) filter will also increase resistance to airflow as the velocity of the air increases. An upper limit occurs when it begins to self-destruct. The higher the airflow capacity of the HEPA filter, the more expensive it becomes. The invention has been designed to operate well within the rated capacity of the filters employed.

(4) Safety features from both an operation and performance perspective include the capability of the system being operated by a broad range of users; ease of mobility of the system; readily available information concerning the condition and functioning of the active components of the system. Also, the combination of the UVGI lamps and the HEPA filter in series protects from purification failure; in this regard, it is noteworthy that any failure in purification makes this kind of machine an infection spreading rather than infection control device.

With the foregoing considerations in mind, the following decisions have been made which have resulted in an air treatment system believed to be far superior to anything currently available. In a first instance, height has been kept to the maximum that would allow a unit to be rolled through a standard 6 ft-8 in high door. In this regard, a unit of the invention is preferably 6 ft-6 in high. This height also leaves about 18 inches below a standard 8-foot ceiling, providing sufficiently close proximity to the ceiling, in most instances, to help extend the airflow and spread it out across the room in which the system is located.

Furthermore, now consider placement of the active components of an air treatment system constructed according to the teachings of the invention. By placing the HEPA filter at the upper regions of the housing for the unit, noise is significantly reduced, and its placement downstream of the ultraviolet UV lamps assures that the filter is disinfected and therefore safe to change. Placement of the fan immediately upstream of the HEPA filter also shields that filter and its associated chamber from the UVGI rays, making it safer during filter changes. The prefilters are placed upstream of the UVGI lamps to protect the lamps against collecting an excess coating of particulate matter on their surfaces and to reduce maintenance costs and effort. A front door on the unit provides full access to the prefilters and UVGI lamps. Additionally, the UVGI lamps are placed in the middle of the unit to sterilize the downstream components, namely, the fan and the HEPA filter. A plurality, typically four in number, of the lamps are oriented so as to maximize the radiation dosage to the airstream and thereby ensure that more than 99% of TB (tuberculosis) bacteria or other bacteria of concern are destroyed. The ballasts for the UVGI lamps are placed at the lowermost regions of the unit for three reasons: stability, cooling and economy of construction. As to stability, the ballasts provide a counterweight mass to lower the center of gravity of the unit and prevent tipping of the mobile configuration, counteracting the weight of the HEPA filter placed at the upper regions of the unit and enabling the unit to comply with the CSA (Canadian Standards Association) 10-degree slope test. This standard relating to electromedical equipment requires castered equipment to remain upright when supported on an incline of 10-degrees with the wheel devices rotated to their most disadvantageous position. As to cooling, the ballasts are placed directly in the intake airflow stream, and for economy of construction, the ballasts are placed in close proximity to the UVGI lamps.

In addition to, or expanding on the foregoing, consider the following features of the invention.

Superior airflow is obtained in the room in which the system is located due to the height of the system and the large separation of the inlet and outlet. This construction produces a more rapid and more complete disinfecting of airborne contaminates because of better air mixing. Also, in this regard, it has interchangeable upper modules that allow for recirculation only, or recirculation and connection to external exhaust for creating negative pressure in the room in which it is installed. In the latter instance, there is a damper on the negative pressure top that controls the amount of air recirculated. In each instance, an outlet grill is formed for positive directional control of the airflow at 45 degrees and also concentrates and increases the speed of the air to enhance the room mixing factor.

Another beneficial feature resides in the combination 0f filters used, the relatively inexpensive prefilters being installed at an upstream location protecting the vastly more expensive HEPA filter and lowering overall operating costs by extending the useful life of the HEPA filter and also of the UVGI lamps.

The system of the invention uses both Ultraviolet Germicidal Irradiation (UVGI) and High Efficiency Particulate Air (HEPA) filtration in series to purify the air. The UVGI lamps are intense enough to kill most organisms, and over 3 times the dose required to kill tuberculosis bacteria to 99+%. The HEPA filter eliminates 99.97% of all particles of 0.3 micron size, which research has shown is the most difficult size to trap. Having UVGI and HEPA in series provides double assurance of purification, and prevents faults from one of the components turning the system into an infection spreader.

Being 6 ft-6 in tall, with the intake at the bottom of the system and the exhaust at the top of the system, maximum separation is obtained between the exhaust air stream and the intake air stream which prevents "short circuiting" of the clean and unclean air streams. Also, with this construction, the clean airstream is exhausted close to the ceiling of the room in which the system is located, allowing the ceiling to aid the distribution and movement of the air. It also sets up a complete circulation of air that ensures clean air supplied at the top of the room, and contaminated air at the bottom of the room, being beneficial to health care providers, because they are usually positioned above the infection source, namely, the patient.

Also, in the system of the invention, the fan is placed between the chamber containing the UVGI lamps and the HEPA filter. This result in significant fan noise reduction as well as in reduced maintenance and longer fan life because only filtered and UVGI disinfected air is passed over and through the fan.

Operation indicators are provided for the system to indicate appropriate operating information including when filter changes and other maintenance should be performed. Among these is a differential pressure gauge that indicates when filters are dirty and significantly reducing air flow. By placing the sensors to sense outside air pressure and also pressure in the high pressure plenum upstream of the HEPA filter, an indication of the status of all the filters can be obtained in reference to the new readings. Also, a warning buzzer may be circuited to the main power supply to indicate power loss and/or electrical disconnection. With continuing regard to instrumentation, an hour meter registers the total time in operation of the system. This facilitates programmed maintenance for the end user and also provides the requisite information for warrantee claims.

Light emitting diode (LED) indicators are provided to show that each of the four UVGI lamps is operating. They are installed in a fail-safe configuration, with the LED being lighted to indicate proper operation.

The system of the invention is designed for either mobile or fixed base use, enabling facile and rapid conversion between the two.

Accordingly, a primary object of the present invention is to provide a self-contained portable air movement and purification system.

Another object of the invention is to provide such a system which is capable of removing particulate and bacterial contaminants and generally purifying air to hospital standards.

A further object of the present invention is to provide an improved air purifier that has an improved filtration efficiency capable of removing from the air particles down to about 0.3 microns in size with an efficiency of 99.97%.

Still another object of the invention is to provide an air purifying system having, in addition to an efficient filtration system, an ultraviolet bacteria killing system employing preferably a plurality of ultraviolet lamps for killing bacteria and viruses.

Yet a further object of the invention is to provide such a system which provides maximum separation between intake and exhaust regions to prevent short circuiting of the clean and unclean air streams.

Another object of the invention is to provide such a system which provides for exhausting the clean air in an inclined stream, causing the purified air stream to flow proximate to and along the ceiling of the room in which the system-is located.

Still a further object of the invention is to provide such a system which comprises an elongated upright enclosed housing including a base module, sidewalls, and an upper module through which an air stream may be caused to flow sequentially, the base module being remote from said upper module, an air stream creating fan intermediate the base module and the upper module for drawing unclean air from the environment into the housing through the base module, then causing a purified air stream to be discharged from the upper module for return to the environment, the base module including an extreme lowermost end defining an intake opening facing, and spaced from, the floor on which the system is supported and an upstream filter device disposed for trapping relatively large particulate matter from the entering air stream, the housing having a germicidal chamber intermediate the upstream filler device and the fan, a plurality of elongated and longitudinally extending ultraviolet germicidal irradiation lamps disposed in the germicidal chamber, a downstream HEPA filter device intermediate the fan and the upper module, and the upper module including a discharge grille defining an opening to the environment, and angled louvers on the discharge grille for guiding and re-directing the purified air stream exiting from the downstream filter device into an inclined stream, causing the purified air stream to flow proximate to and along the ceiling of the room in which the system is located and, because of the remoteness of the upper module from said base module, minimizing undesirable mixing of unclean and purified air.

Yet another object of the invention is to provide such a system which provides a discharge grille defining a recirculation opening zone to the room in which the air movement and purification system is located and an exhaust opening zone to an exterior region outside of the room, angled louvers attached to the discharge grille at the recirculation opening zone for guiding and re-directing one part of the purified air stream into an inclined air stream, after exiting the downstream filtration means, causing the purified air stream to flow proximate to and along the ceiling of the room in which the system is located and, because of the remoteness of the upper module from the base module, minimizing undesirable mixing of unclean and purified air, and a conduit attached to the upper module at the exhaust opening zone for containing and guiding flow of a remaining part of the purified air stream to an exterior region outside the room to thereby create a negative pressure in the room in relation to the exterior region.

Another object of the present invention is to provide a plurality of ultraviolet lamps which are arranged in a vertical fashion within the housing of the air movement and purifying system so that the particles to be collected travel the length of the lamps thereby affording more exposure than if they traveled in another direction with relationship to the lamps.

Still another object of the present invention is to provide an air movement and purifying system that is compact, quiet, and attractive, requiring no special installation, and that is easy to move from room to room, if necessary.

Other and further features and advantages of the present invention will become more apparent from the following detailed description, taken in conjunction with the accompanying drawings which illustrate, by way of example, the principles of the invention. Throughout the specification, like numerals refer to like parts.

BRIEF DESCRIPTION OF THE DRAWINGS

In the drawings:

FIG. 3 is a side elevation view of the air moving and purification system illustrated in FIG. 1, with the covering panels removed;

FIG. 4 is a bottom plan view of the system illustrated in FIGS. 1–3;

FIG. 6 is a perspective view illustrating the operation of a system according to the invention;

DETAILED DESCRIPTION OF THE PREFERRED EMBODIMENTS

Figure 1:
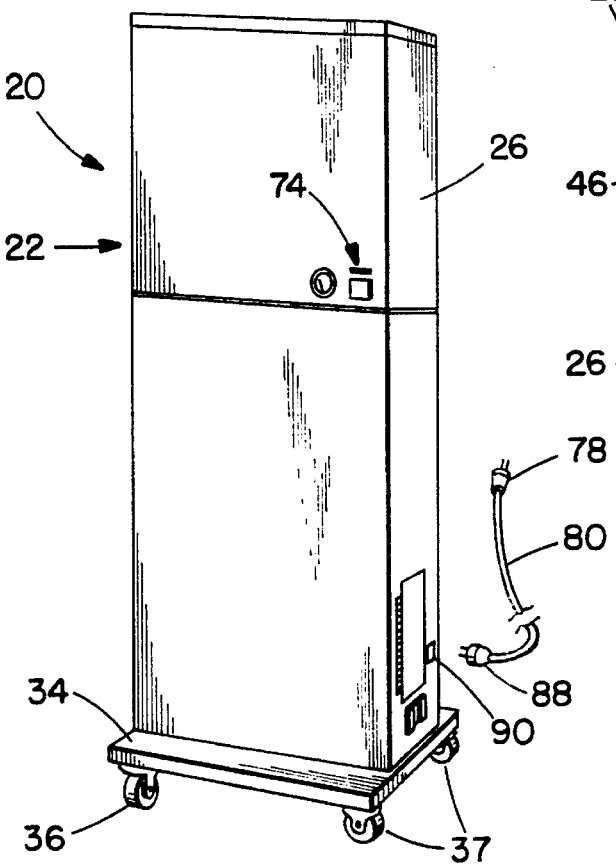
FIG. 1 is a perspective view of an air moving and purification system embodying the present invention.
Figure 2:
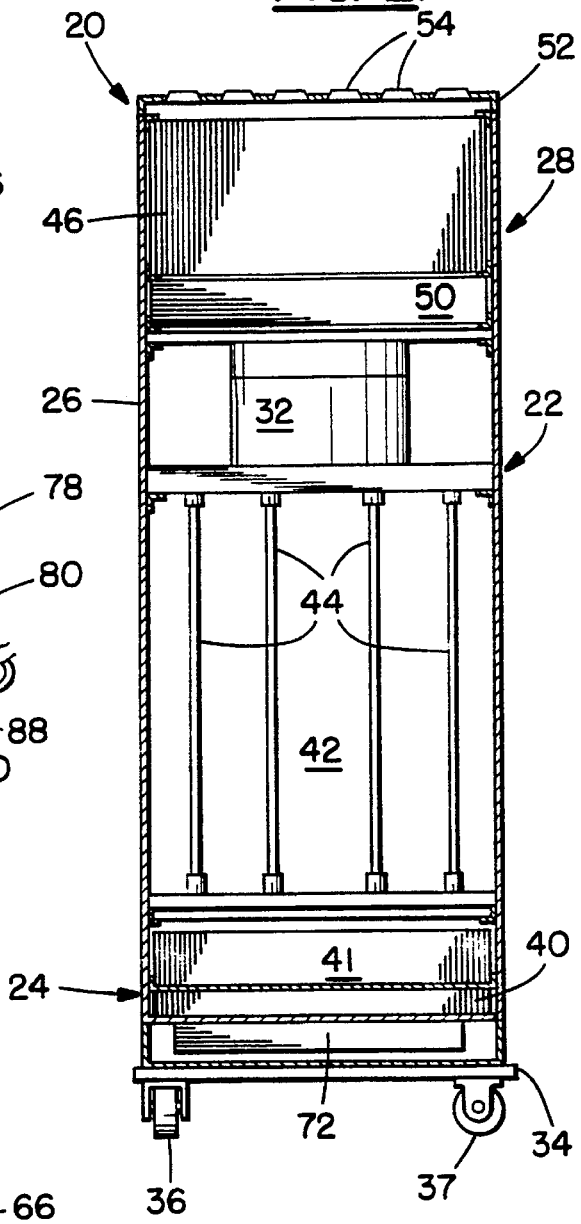
FIG. 2 is a front elevation view of the air moving and purification system illustrated in FIG. 1, with the covering panels removed.

Turn now to the drawings and, initially, to FIGS. 1, 2, and 3 which illustrate a self contained air movement and purification system 20 for infection control embodying the present invention. The system 20 comprises an elongated upright enclosed housing 22 including a base module 24, sidewalls 26, and an upper module 28 through which an air stream defined by arrows 30 (FIG. 3) may be caused to flow sequentially. The base module is remote from the upper module so as to minimize undesirable mixing of unclean and purified air in a manner to be described.

A continuous duty fan of suitable capacity is positioned within the housing 22 intermediate the base module 24 and the upper module 28 for drawing unclean air from the environment into the housing through the base module, then causing a purified air stream to be discharged from the upper module for return to the environment.

The base module 24 includes a platform 34 which supports the sidewalls 26 and wheel devices 36, 37 such as casters mounted on the platform for providing mobility to the system 20. The wheel devices 36, 37 are preferably high quality full roller bearing casters which render movement of the system 20 easy and quiet even on uneven surfaces such as elevators, entries, and door thresholds. Also, preferably, the wheel devices 36, 37 are capable of being locked so as to render the system 20 stationary when it has been placed in the desired location.

An extreme lowermost end of the base module 24 includes an intake opening plate 38 (FIG. 4) which faces, and is spaced from, the floor on which the system 20 is supported. A pair of upstream filter devices 40, 41 are disposed in a stacked relationship for trapping relatively large particulate matter from the entering air stream. The filter devices 40, 41 may be, for example, approximately 25–30% ASHRAE-rated filters. They serve to retain the cleanliness of all components of the system located downstream of them, reducing their degradation over time and increasing the life of each. In this regard, the filter 40 may typically be 2 inches thick and be considered a primary pre-filter used as an initial filter to catch all of the larger particles, dust and the like. The filter 41 may typically be 4 inches thick and used a longer-life and more expensive pre-filter requiring substantially less changing than the initial or primary less expensive pre-filter 40.

A germicidal chamber 42 is provided in the housing 22 intermediate the upstream filter devices 40 and the fan 32. Elongated and longitudinally extending ultraviolet germicidal irradiation members are disposed in the germicidal chamber. More specifically, the ultraviolet germicidal irradiation members include a plurality of ultraviolet lamps 44 which are aligned generally parallel to the air stream 30 flowing through the germicidal chamber. The lamps 44 may be of 55-watt output, for example, having a dose rate that is three times that needed to kill tuberculosis bacteria. Making that statement in another way, the lamps 44 preferably have sufficient intensity to destroy more than approximately 99% of tuberculosis bacteria present in the air stream when the flow rate of the air stream through the system is in a range up to approximately 500 cfm. With the system of the invention, most other bacilli are also destroyed. The dosage required for complete destruction of the tuberculosis bacterium is in the midrange of the ultraviolet lamps 44 intended for the system 20. Further the dosage available is 15 times greater than that needed to destroy pneumonia, five times greater than that needed to destroy *E. Coli* bacterium, and four times greater than that needed to destroy the infectious hepatitis virus.

Downstream of the germicidal chamber 42, within the housing 22, is positioned a filter device 46 intermediate the fan 32 and the upper module 28. The downstream filter device 46 is a HEPA (High Efficiency Particulate Air) filter which is capable of removing from the air stream approximately 99.97% of all particles of 0.3 micron size. The downstream filter device 46 has a broad intake surface 48 facing the fan 32 and the housing 22 has a plenum chamber 50 intermediate the fan and the downstream filter device for spreading the air stream uniformly across the intake surface.

Figure 5:
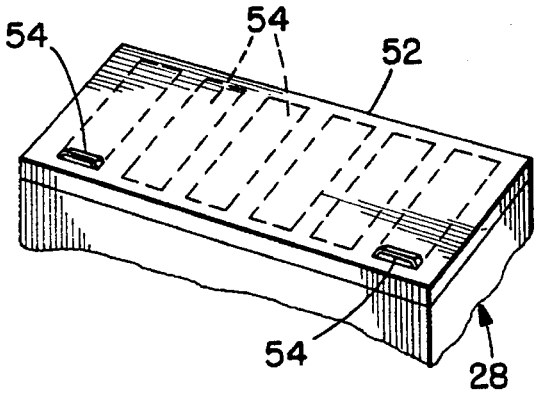
FIG. 5 is a detail perspective view of one component of the system of the invention.

As seen especially well in FIGS. 2, 3, and 5, the upper module 28 includes a discharge grille 52 defining an opening zone to the environment. Specifically, a plurality of angled louvers 54 are formed on the discharge grille 52 for guiding and re-directing a purified air stream defined by arrows 56 from the downstream filter device 46 into an inclined stream after exiting the downstream filter device. In this manner, the purified air stream 56 is caused to flow proximate to and along a ceiling 58 (FIG. 6) of the room in which the air movement and purification system 20 is located. The air stream immediately fans out on contact with the ceiling setting up a complete mixing pattern within the room. In a typical installation, these special louvers direct the purified air stream at a 45° angle to the ceiling with a velocity which may be in excess of 500 fpm. Additionally, because of this velocity and the remoteness of the upper module 28 from the base module 24, undesirable mixing of unclean and purified air is minimized.

Figure 7:
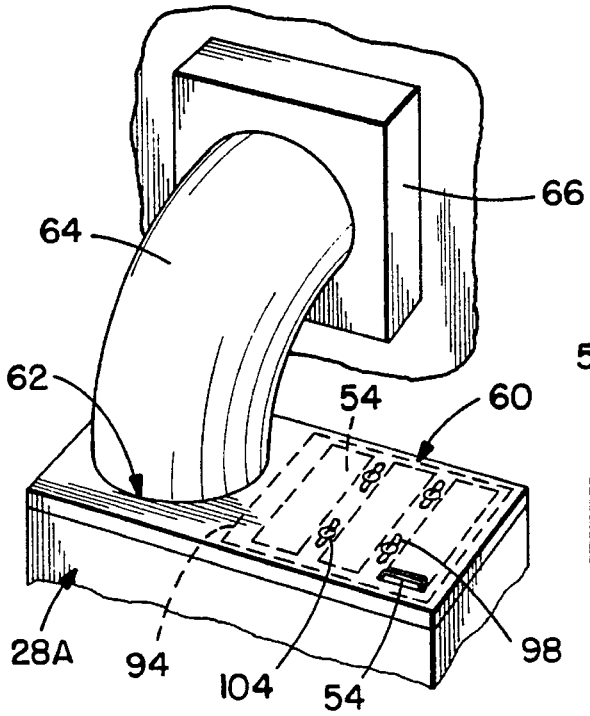
FIG. 7 is a detail perspective view of another component of the system of the invention, modified from the construction illustrated in FIG. 5.

In another embodiment of the invention, viewing FIG. 7, a modified upper module 28A includes a modified discharge grille 52A defining a recirculation opening zone 60 directed into the room in which the system 20 is located and a exhaust opening zone 62 directed to an exterior region outside of the room. Angled louvers 54 similar to those illustrated in FIG. 5 are provided on the discharge grille 52A at the recirculation opening zone. As in the FIG. 5 embodiment, the louvers 54 serve for guiding and re-directing one part of the purified air stream into an inclined air stream. In this instance, after exiting the downstream filter device 46, the purified air stream is caused to flow proximate to and along the ceiling 58 (FIG. 6) of the room in which the system 20 is located.

Additionally, a suitable discharge conduit 64 is attached to the upper module 28A at the exhaust opening zone 62 for containing and guiding flow of a remaining part of the purified air stream through a discharge outlet member 66 to an exterior region outside the room in which the system 20 is located. In this manner, a negative pressure is created in the room in relation to the exterior region. This negative pressure assures that any contaminants in the room remain there to be filtered out by the system 20 and guards against their flight, undesirably, to regions outside of the room.

In FIG. 6, the optimum air flow pattern for control of airborne contaminants as provided by the system 20 is indicated. In a typical design, the system 20 is 6 ft 6 in. tall, with the intake opening plate 38 at the bottom of the system and the exhaust at the top of the system. This is the same approach used for the design of a hospital operating room. This design offers the maximum separation which prevents "short circuiting" of the clean air stream 56 and a unclean air stream 70 shown entering the base module 24. In FIG. 6, it is also seen that the purified air stream 56 is exhausted close to the ceiling 58, allowing the ceiling to aid the distribution and movement of the air. In this manner, a complete circulation of air is also set up that is beneficial to health care providers. More specifically, the arrangement whereby clean air is supplied at the top of the room, and contaminated air is withdrawn for filtration at the bottom of the room, ensures that clean air is positioned above the infection source, namely, the patient.

As seen in FIGS. 2, 3, and 4, ballasts 72, that is, transformers for starting and operating the UV lamps 44, are suitably mounted on the base module 24 and this placement simultaneously serves two functions. In a first instance, they are directly exposed to the entering, albeit unclean, air stream 70 such that they are continuously being cooled. Secondly, they provide counterweight mass to lower the center of gravity of the unit and prevent tipping of the mobile configuration of the system 20.

Figure 8:
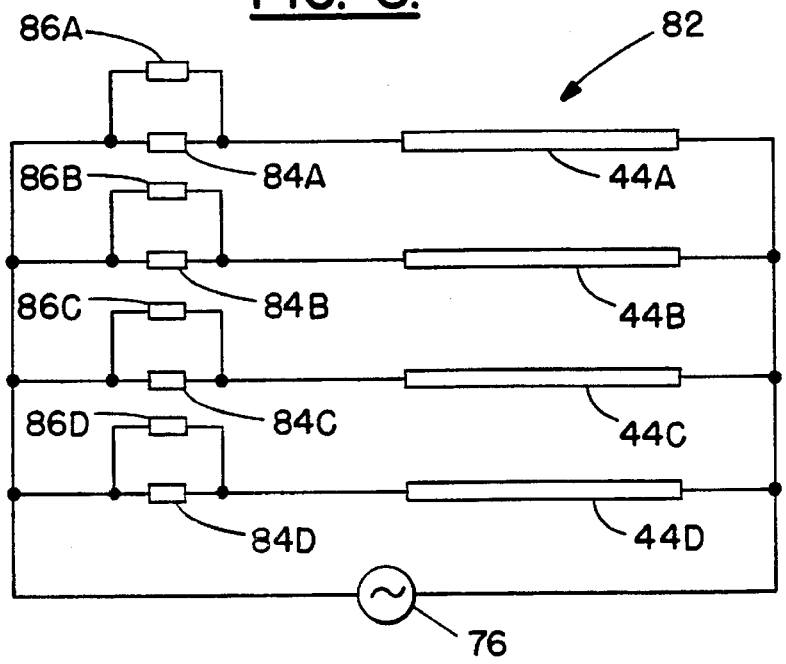
FIG. 8 is an electrical block diagram illustrating another embodiment of the invention.
Figure 9:
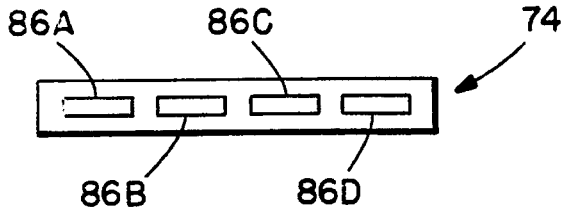
FIG. 9 is a front elevation view illustrating in greater detail a component illustrated in FIG. 1.

Turn now to FIGS. 8 and 9 for the description of another embodiment of the invention. Preferably, the system 20 also includes an indicator display 74 (FIG. 1) outside of the housing 22 for indicating the condition of operation of each of the plurality of ultraviolet lamps 44A, 44B, 44C, 44D located inside the housing. As seen in FIG. 8, the ultraviolet lamps are energized by a suitable EMF source 76 as occurs when a plug 78 attached to a power cord 80 from the system 20 is connected to a wall outlet in the room in which the system is located. An indicator system 82 (FIG. 8) includes a plurality of resistors, 84A, 84B, 84C, 84D, each electrically in series with its associated one of the ultraviolet lamps. In similar fashion, each of a plurality of light emitting diodes, 86A, 86B, 86C, 86D, is electrically in parallel with an associated one of the resistors. Each light emitting diode is energized when its associated ultraviolet lamp is energized and is deenergized when its associated ultraviolet lamp is non-functioning. As seen in FIG. 9, the indicator display 74 includes each of the light emitting diodes, 86A, 86B, 86C, 86D.

Now turn back to FIG. 1 for another desirable feature of the invention. At a proximal end, the power cord 80 may have a quick disconnect plug 88 for releasable engagement with a quick disconnect power block receptacle 90 on a sidewall 26 of the housing 22. It may also be desirable to fix the pair of wheel devices 37 immediately beneath the power block receptacle 90 such that they are rotatable only about an axis which is parallel to, or lies in the plane of, the sidewall 26 containing the power block receptacle and are thereby fixedly aligned in a direction parallel to that of insertion and withdrawal of the plug 80A relative to the power block 81. With this construction, should the system be inadvertently moved to impart tension on the power cord 80, it would be in the direction of desired withdrawal of the plug 88 from the power block receptacle 90 thereby avoiding undesired fraying of the cord.

Figure 10:
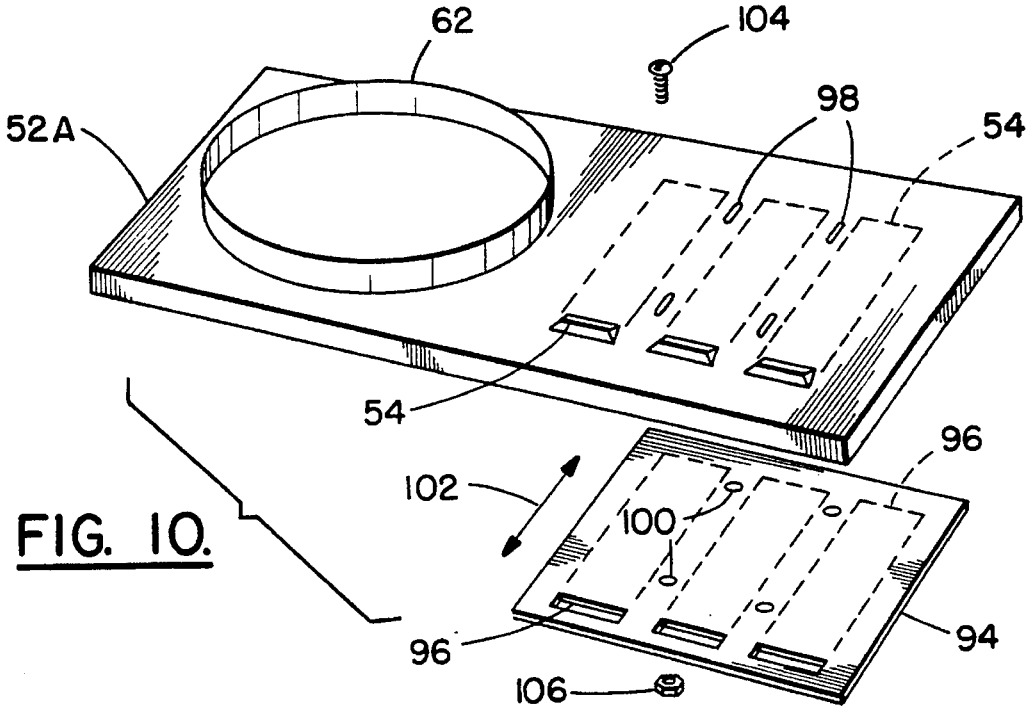
FIG. 10 is a perspective exploded view illustrating another embodiment of the invention, specifically, an adjustable damper assembly enabling the amounts of the purified air stream being exhausted or recirculated to be balanced.

For the embodiment described with respect to FIG. 7, an adjustable damper assembly 92 (FIG. 10) may be provided behind the discharge grille 52A allowing the amounts of the purified air stream being exhausted or recirculated to be balanced, that is, selectively directed to the recirculation opening zone 60 and to the exhaust opening zone 62, respectively. This ability to selectively exhaust and/or recirculate the purified air stream saves significantly on energy costs.

The adjustable damper assembly 92 includes a planar grate member 94 having a plurality of grate openings 96 congruently sized and spaced with respect to the louvers 54 in the discharge grille 52A. The grate member 94 proximately underlies the discharge grille 52A. The latter has a plurality of elongated mounting slots 98 formed therein and the former has a plurality of clearance holes 100 formed therein which are substantially aligned with the mounting slots when the grate member and discharge grille are proximately positioned.

Suitable fastener members mount the grate member 94 on the discharge grille 52A for selective manual movement in opposite directions, as indicated by a double arrowhead 102, between a first position at which the grate openings 96 are completely aligned with the louvers 54 and allow a maximum flow of the purified air stream into and through the exhaust opening zone 62 and a second position at which the discharge grill substantially blocks flow of the purified air stream into and through the exhaust opening zone. The fastener members include a plurality of mounting screws 104 slidably received through each aligned pair of the mounting slots 98 and clearance holes 100. A similar plurality of mounting nuts 106 are threadedly engaged with the mounting screws for fixedly securing the grate member 94 to the discharge grille 52A.

The mounting slots 98 are elongated in the direction of movement of the grate member 94 between the first and second positions explained above. The mounting nuts 106 are tightened onto the mounting screws 104 when the grate member 94 has been properly positioned to obtain the desired balance of the purified air stream between the recirculation opening zone 60 and the exhaust opening zone 62.

While preferred embodiments of the invention have been disclosed in detail, it should be understood by those skilled in the art that various other modifications may be made to the illustrated embodiments without departing from the scope of the invention as described in the specification and defined in the appended claims.

What is claimed is:

1. A self contained air movement system for air purification and infection control comprising:

an elongated upright enclosed housing including a base module, sidewalls, and an upper module through which an air stream may be caused to flow sequentially, said base module being remote from said upper module;

fan means intermediate said base module and said upper module for drawing unclean air from the environment into said housing through said base module, then causing a purified air stream to be discharged from said upper module for return to the environment;

said base module including an extreme lowermost end defining an intake opening facing, and spaced from, the floor on which said system is supported and upstream filtration means disposed for trapping relatively large particulate matter from the entering air stream;

said housing having a germicidal chamber intermediate said upstream filtration means and said fan means;

elongated and longitudinally extending ultraviolet germicidal irradiation means disposed in the germicidal chamber;

downstream filtration means intermediate said fan means and said upper module; and said upper module including:

a discharge grille defining opening means to the environment; and angled louver means on said discharge grille for guiding and re-directing the purified air stream from said downstream filtration means into an inclined stream, after exiting said downstream filtration means, causing the purified air stream to flow proximate to and along the ceiling of the room in which said air movement and purification system is located and, because of the remoteness of said upper module from said base module, minimizing undesirable mixing of unclean and purified air.

2. An air movement system as set forth in claim 1 wherein said base module includes a platform supporting said sidewalls and wheel means mounted on said platform for providing mobility to said system.

3. An air movement system as set forth in claim 2 including:

a power block receptacle mounted in one of said sidewalls for releasable engagement with a power cord extending to an EMF source; and wherein said wheel means includes a first pair of spaced apart wheels which are rotatable about an axis lying in a plane of said one of said sidewalls and a second pair of wheels which are rotatable about axes which are free to pivot about an upright axis.

4. An air movement system as set forth in claim 1 wherein said upstream filtration means includes a pair of approximately 25–30% ASHRAE-rated filters in a stacked relationship.

5. An air movement system as set forth in claim 1 wherein said ultraviolet germicidal irradiation means includes a plurality of ultraviolet lamps aligned generally parallel to the air stream flowing through the germicidal chamber and having sufficient intensity to destroy more than approximately 99% of tuberculosis bacteria present in the air stream when the flow rate of the air stream through said system is in a range up to approximately 500 cfm.

6. An air movement system as set forth in claim 1 including: indicator means outside of said housing for indicating the condition of operation of said plurality of ultraviolet lamps located inside said housing.

7. An air movement system as set forth in claim 1 wherein said indicator means includes a resistor electrically in series with each of said ultraviolet lamps and a light emitting diode electrically in parallel with each of said resistors, said light emitting diode being energized when said ultraviolet lamps are energized and being de-energized when said ultraviolet lamps are non-functioning.

8. An air movement system as set forth in claim 1 wherein said downstream filtration means includes a HEPA filter which is capable of removing from the air stream approximately 99.97% of all particles of 0.3 micron size or larger.

9. An air movement system as set forth in claim 1 wherein said downstream filtration means includes a broad intake surface facing said fan means; and wherein said housing has a plenum chamber intermediate said fan means and said downstream filtration means for spreading the air stream from said fan means uniformly across said intake surface.

10. A self contained air movement system for air purification and infection control comprising:

an elongated upright enclosed housing including a base module, sidewalls, and an upper module through which an air stream may be caused to flow sequentially, said base module being remote from said upper module;

fan means intermediate said base module and said upper module for drawing unclean air from the environment into said housing through said base module, then causing a purified air stream to be discharged from said upper module for return to the environment;

said base module including an extreme lowermost end defining an intake opening facing, and spaced from, the floor on which said system is supported and upstream filtration means disposed for trapping relatively large particulate matter from the entering air stream;

said housing having a germicidal chamber intermediate said upstream filtration means and said fan means;

elongated and longitudinally extending ultraviolet germicidal irradiation means disposed in the germicidal chamber;

downstream filtration means intermediate said fan means and said upper module; and said upper module including:

a discharge grille defining recirculation opening means to the room in which said air movement system is located and exhaust opening means to an exterior region outside of the room;

angled louver means attached to said discharge grille at said recirculation opening means for guiding and re-directing one part of the purified air stream into an inclined air stream, after exiting said downstream filtration means, causing the purified air stream to flow proximate to and along the ceiling of the room in which said air movement system is located and, because of the remoteness of said upper module from said base module, minimizing undesirable mixing of unclean and purified air; and conduit means attached to said upper module at said exhaust opening means for containing and guiding flow of a remaining part of the purified air stream to an exterior region outside the room in which said system is located to thereby create a negative pressure in the room in relation to the exterior region.

11. An air movement system as set forth in claim 10 including:

adjustable damper means for balancing the amount of the purified air stream to be directed to said recirculation opening means and to said exhaust opening means, respectively.

12. An air movement system as set forth in claim 11 wherein said damper means includes:

a planar grate member having a plurality of grate openings congruently sized and spaced with respect to said louvers in said discharge grille, said grate member proximately overlying said discharge grille; and fastener means mounting said grate member for selective movement between a first position whereat the grate openings are completely aligned with said louvers and allow a maximum flow of the purified air stream into and through said exhaust opening means and a second position whereat said discharge grill substantially blocks flow of the purified air stream into and through said exhaust opening means.

13. An air movement system as set forth in claim 12 wherein said discharge grille has a plurality of mounting slots therein elongated in the direction of movement of said grate member between said first and second positions;

wherein said grate member has a plurality of clearance holes therein substantially aligned with the mounting slots in said discharge grill; and wherein said fastener means includes:

a plurality of mounting screws slidably received through each aligned pair of the mounting slots and clearance holes; and a plurality of mounting nuts threadedly engaged with said mounting screws for fixedly securing said grate member to said discharge grille.

14. A self contained air movement system for air purification and infection control comprising:

an elongated upright enclosed housing including a base module, sidewalls, and an upper module through which an air stream may be caused to flow sequentially;

fan means intermediate said base module and said upper module for drawing unclean air from the environment into said housing through said base module, then causing a purified air stream to be discharged from said upper module for return to the environment;

said base module including an extreme lowermost end defining an intake opening facing, and spaced from, the floor on which said system is supported and upstream filtration means disposed for trapping relatively large particulate matter from the entering air stream;

said housing having a germicidal chamber intermediate said upstream filtration means and said fan means;

elongated and longitudinally extending ultraviolet germicidal irradiation means disposed in the germicidal chamber; and downstream filtration means intermediate said fan means and said upper module;

said upper module including angled louver means for guiding and re-directing the purified air stream into an inclined air stream, after exiting said downstream filtration means, causing the purified air stream to flow proximate to and along the ceiling of the room in which said air movement system is located;

said base module being remote from said upper module thereby minimizing undesirable mixing of unclean and purified air.

* * * * *